US012560342B2

(12) United States Patent
Mutter et al.

(10) Patent No.: US 12,560,342 B2
(45) Date of Patent: Feb. 24, 2026

(54) PASSIVE RIDGE VENTS FOR METAL ROOFS

(71) Applicant: O'Daniels, LLC., Henderson, NV (US)

(72) Inventors: David S. Mutter, Santa Rosa, CA (US); Gregory S. Daniels, Santa Rosa, CA (US); William B. Daniels, II, Las Vegas, NV (US)

(73) Assignee: O'Daniels, Inc., Henderson, NV (US)

( * ) Notice: Subject to any disclaimer, the term of this patent is extended or adjusted under 35 U.S.C. 154(b) by 208 days.

(21) Appl. No.: 18/424,810

(22) Filed: Jan. 28, 2024

(65) Prior Publication Data

US 2025/0244032 A1 Jul. 31, 2025

(51) Int. Cl.
*F24F 7/02* (2006.01)
*E04D 13/17* (2006.01)

(52) U.S. Cl.
CPC ..... *F24F 7/02* (2013.01); *E04D 13/174* (2013.01)

(58) Field of Classification Search
CPC ..... F24F 7/02; E04D 13/174
See application file for complete search history.

(56) References Cited

U.S. PATENT DOCUMENTS 183,532 A * 10/1876 Brock ..... E04D 13/174 454/365
4,545,291 A * 10/1985 Kutsch ..... E04D 13/174 454/365
4,545,292 A * 10/1985 Inokawa ..... E04D 13/174 277/637
5,326,318 A * 7/1994 Rotter ..... E04D 13/174 454/365
5,339,582 A * 8/1994 Sells ..... E04D 13/174 454/365
5,924,925 A * 7/1999 Nystrom ..... E04D 13/158 454/365
6,088,971 A * 7/2000 Nystrom ..... F24F 7/02 52/95
6,128,869 A * 10/2000 Brotherton ..... F24F 7/02 52/302.1
6,128,870 A * 10/2000 Kohler ..... E04D 13/174 52/302.6
6,997,800 B1 * 2/2006 Kohler ..... E04D 13/178 454/365
7,485,034 B2 * 2/2009 Sells ..... F24F 7/02 454/365
8,075,376 B1 * 12/2011 Inzeo ..... E04D 13/1478 454/367
9,528,272 B2 * 12/2016 Knighton ..... E04D 13/174
9,657,480 B1 * 5/2017 Inzeo ..... E04D 13/158
9,803,367 B2 * 10/2017 Rotter ..... E04D 13/176
2016/0215500 A1 * 7/2016 Van Noort ..... E04D 13/174
2024/0183549 A1 * 6/2024 Harris ..... E04D 13/174

FOREIGN PATENT DOCUMENTS

WO WO-2014143787 A1 * 9/2014 ..... F24F 7/02

* cited by examiner

*Primary Examiner* — Adriana Figueroa
(74) *Attorney, Agent, or Firm* — Paul J. Backofen, Esq.

(57) ABSTRACT

A passive ridge vent for metal roofs provides a passive ridge ventilation solution that when coupled with vents in the field and eave provide a complete attic ventilation solution. The passive ridge vent is secured in an opening along the ridge between rafters and the side and edge wings seal against any suitable metal roof. The input/exhaust channels extend through vertical side walls to minimize the energy needed to cause convection out of the chimney.

9 Claims, 3 Drawing Sheets

PASSIVE RIDGE VENTS FOR METAL ROOFS

FIELD OF THE INVENTIONS

The inventions described below relate to the field of roof ventilation.

BACKGROUND OF THE INVENTIONS

Ventilation of structures is required by most building codes which typically require ventilation and dictate the amount of required ventilation. Most jurisdictions require a certain amount of "net free ventilating area," (NFVA) which is a well-known and widely used measure for ventilation. Ventilation also has numerous benefits for both the building and its occupants. For example, ventilation of an attic space can prevent the attic's temperature from rising to undesirable levels, which also reduces the cost of cooling the interior living space of the building. In addition, increased ventilation in an attic space tends to reduce the humidity within the attic, which can prolong the life of the materials used in the building's construction by diminishing the incidence of mold, dry-rot and other deteriorating conditions. Some ridge vents require the input and output channels to be in a horizontal surface which requires more energy in the heated air to cause it to move through the ventilation spaces in horizontal surfaces and as a consequence, such vents require fans or other energy sources to drive air movement. This is unsuitable for passive ventilation systems.

Buildings with metal roofs rarely have adequate attic ventilation as the metal roofs provide a difficult challenge.

SUMMARY

The passive ridge vent for metal roofs provides a passive ridge ventilation solution that when coupled with vents in the field and eave provide a complete attic ventilation solution. The passive ridge vent is secured in an opening along the ridge between rafters, and sometimes through rafter depending on the length of the vent, with side and edge wings that seal against any suitable metal roof. The input/exhaust channels extend through vertical side walls to minimize the energy needed to cause convection out of the chimney.

An alternative configuration straddles the roof ridge board and provides ventilation from either side of the ridge board.

A passive ridge vent for a metal roof comprises a generally vertical chimney having a bottom and a top with a screen floor at the bottom and an optionally screened split input/exhaust channel at the top, and a bottom wing surrounding the chimney adapted to support the chimney and engage the metal roof, and a generally planar cap covering the passive ridge vent generally parallel to the bottom wing, and a plurality of spacers engaging the cap and the bottom wing defining the input/exhaust channel through two apposing vertical sides of the chimney, and filter mesh filling the chimney from the screen floor at the bottom to the split input/exhaust channel at the top.

A passive ridge vent for a metal roof with rafters comprises a generally vertical chimney having two long sides and two short sides, a bottom and a top with a screen floor at the bottom and a wing surrounding the chimney adapted to support the chimney and engage the metal roof at the top, wherein the wing has an external diverter, and a plurality of spacers engaging the wing and separating the wing from the metal roof defining the input/exhaust channel extending through the long vertical side walls above the wing, the input/exhaust channel having an optional screen covering the openings in the long side walls, and a vertically adjustable cap adapted to engage the chimney and cover the passive ridge vent generally parallel to the wing, and two or more anchors for securing the chimney to at least one of the rafters, and filter mesh filling chimney from the screen floor at the bottom to the input/exhaust channel at the top.

DETAILED DESCRIPTION OF THE INVENTIONS

Figure 1:
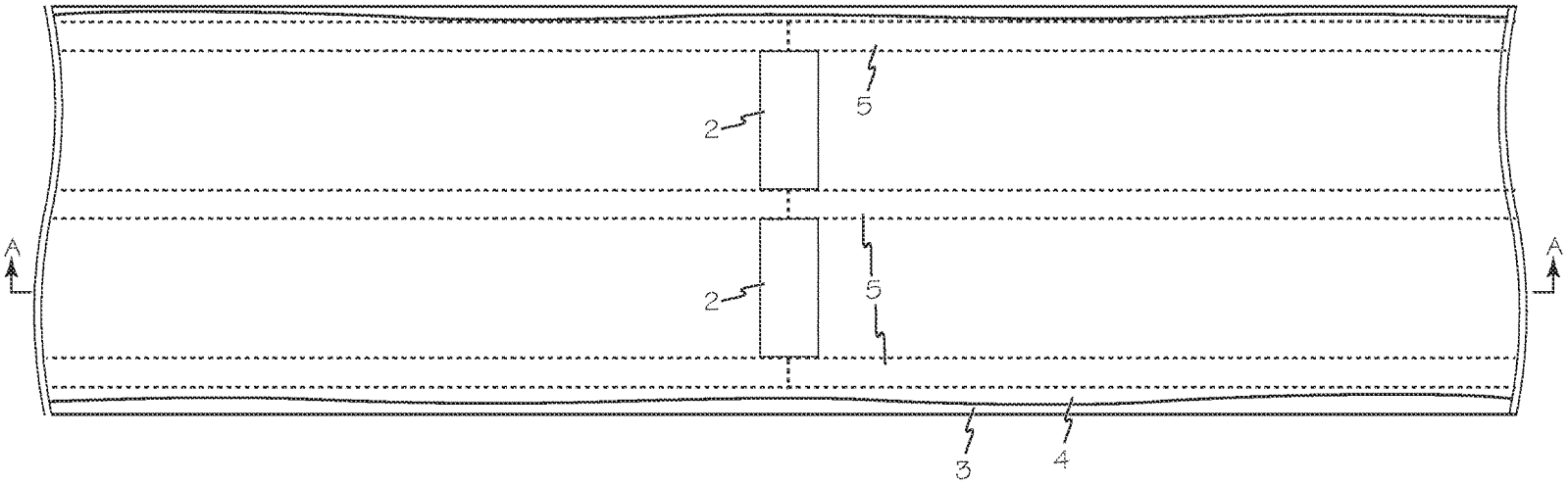
FIG. 1 is a top view of a metal roof with openings at the ridge for passive ridge vents.

FIG. 1 illustrates a top view of metal roof 1 with openings 2 through sheathing 3 and/or the metal roof or metal skin 4, between rafters 5. Depending on the length of the ridge vent, the vent may extend through one or more rafter sets in the roof. The roof may have battens, bare rafters or any other suitable building technique, instead of sheathing 3, to support the metal roof skin 4.

Figure 4:
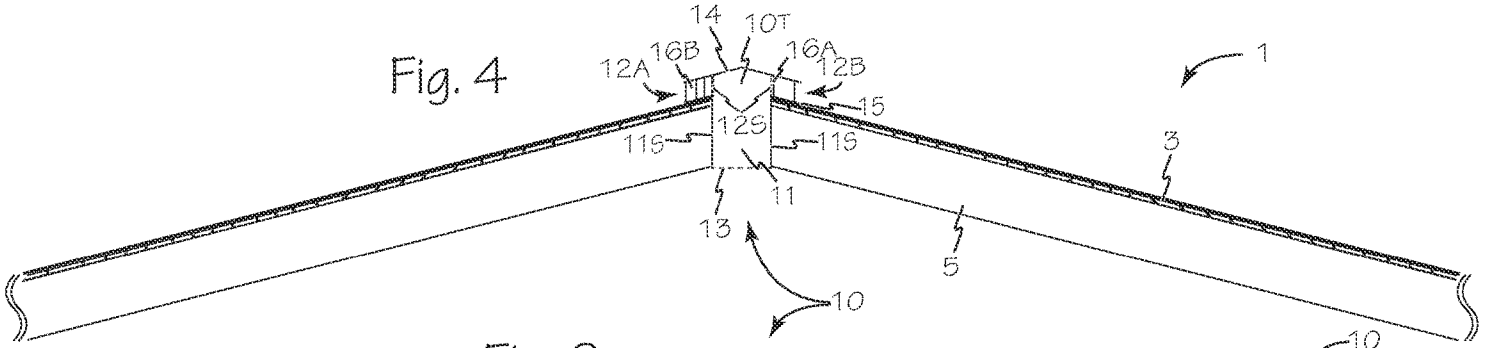
FIG. 4 is a cross-section view of the metal roof of FIG. 1 taken along A-A with a cross-section of the passive ridge vent of FIG. 2 taken along B-B.
Figure 5:
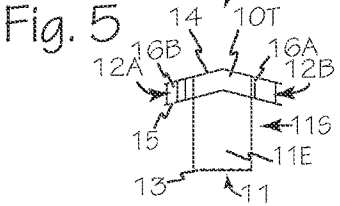
FIG. 5 is an end view of the passive ridge vent of FIG. 2.
Figure 2:
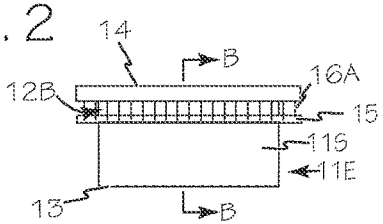
FIG. 2 is a side view of a passive ridge vent.

FIG. 2 illustrates a cross-section view of the metal roof 1 of FIG. 1 taken along A-A, with a cross-section of the passive ridge vent 10 of FIG. 4 taken along B-B, installed in roof opening 2. FIGS. 2, 3, 4 and 5 show passive ridge vent 10 is formed around a rectangular and generally vertical chimney 11 with split input/exhaust channels 12A and 12B extending through the long vertical side walls 11*s* at the top 10T of the passive ridge vent and a screened floor 13 at the bottom of the chimney. Input/exhaust channels 12A and 12B may also include optional screen 12S covering the input/exhaust opening through the long side wall of chimney 11. Screened floor 13 and optional input/exhaust screen 12S are made with any suitable screen such as ¼ steel mesh although any suitable material and mesh size may be used such as ⅛ mesh made of stainless steel, brass, copper, plastic, intumescent material or other.

Figure 3:
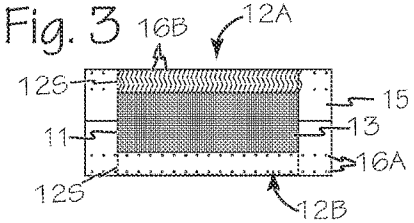
FIG. 3 is a top view of the passive ridge vent of FIG. 2 with the cap removed.

The top of chimney 11 is covered by a generally planar cap 14 which is generally parallel to metal roof 4 and overhangs the long sides 11S and short ends 11E of chimney 11 as illustrated in FIGS. 3 and 4. Chimney 11 is supported and sealed to the metal roof skin 4 by bottom wing 15. A plurality of spacers 16A, shown in input/exhaust channel 12A, and or baffles 16B, shown in input/exhaust channel 12B, maintain the separation between cap 14 and bottom wing 15 and in the case of baffles 16B they control airflow through the input/exhaust channels and prevent the entry of wind driven fire, embers, or rain. Spacers 16A and baffles 16B may have any suitable spacing or geometry. Spacers 16A may be generally cylindrical or have a square, octagonal or other suitable cross section. Optional screen 12S may be secured inside chimney 11 as illustrated in FIG. 4, or it may be secured over the outside of the baffles and or spacers and input/exhaust channels 12A and 12B as illustrated in FIG. 3.

Figure 7:
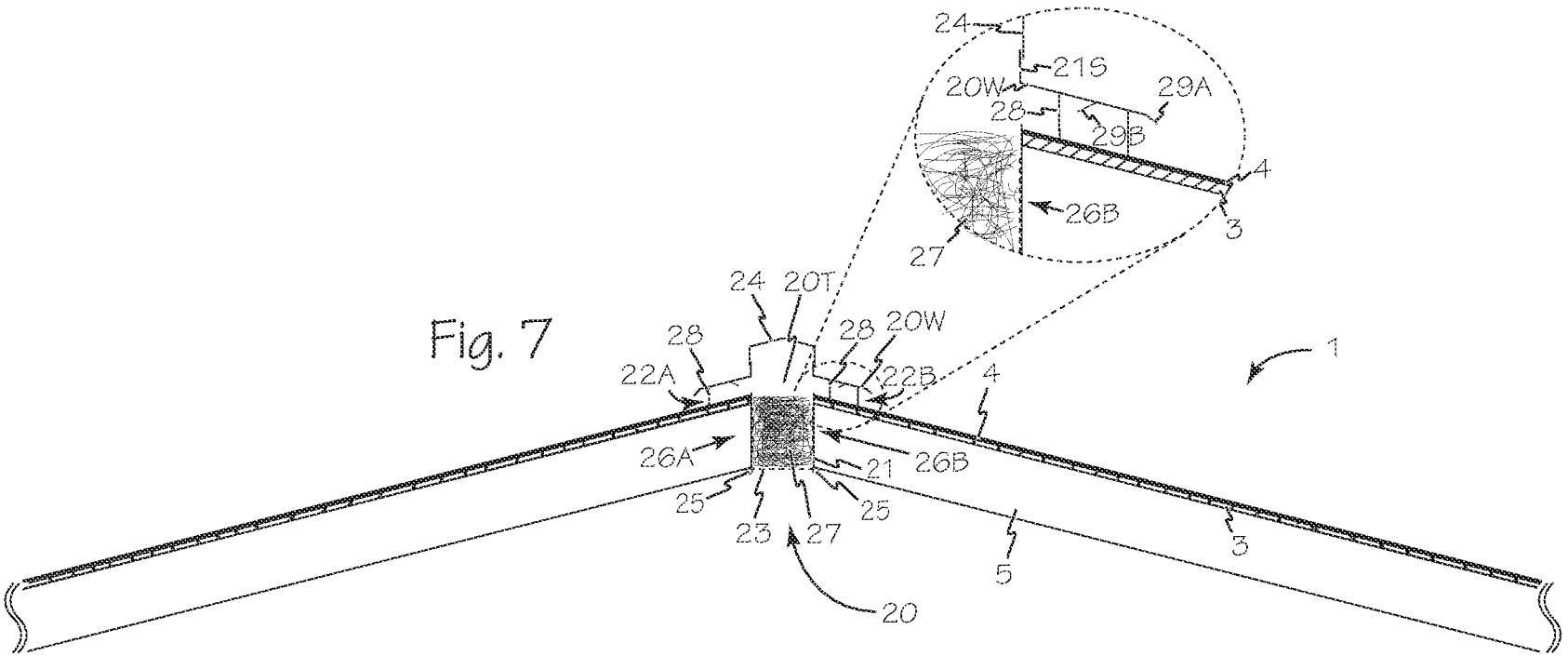
FIG. 7 is a cross-section view of the metal roof of FIG. 1 taken along A-A with a cross-section of the alternate passive ridge vent of FIG. 6 taken along C-C.
Figure 8:
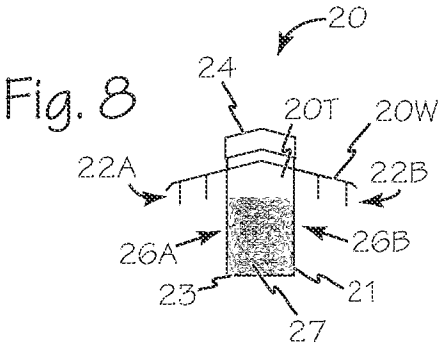
FIG. 8 is an end view of the alternate passive ridge vent of FIG. 6.
Figure 6:
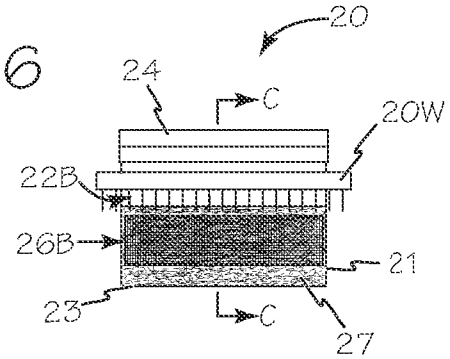
FIG. 6 is a side view of an alternate passive ridge vent.

FIG. 7 illustrates a cross-section view of the metal roof 1 of FIG. 1 taken along A-A, with a cross-section of the alternate passive ridge vent 20 of FIG. 6 taken along C-C, installed in roof opening 2. FIGS. 6 and 7 show alternate passive ridge vent 20 is formed around a generally vertical chimney 21 with split input/exhaust channels 22A and 22B extending through the vertical side walls 21S at the top 20T of chimney 21 and a screened floor 23 at the bottom. Input/exhaust channels 22A and 22B are formed between vent wing 20W and metal roof skin 4 through vertical side walls 21S. Vent wing 20W is generally parallel to the metal roof skin 4. The top of chimney 21 is covered by a removable, vertically adjustable, solid cap 24 which overhangs the sides and ends of chimney 21 as illustrated in FIGS. 6, 7 and 8.

Chimney 21 is supported and anchored to two or more of rafters 5 using removable and adjustable anchors 25. Chimney 21 may also include side openings such as side openings 26A and 26B through the long vertical side walls beneath the exhaust channels and withing the attic space. Screened floor 23 and side openings 26A and 26B are made with any suitable screen such as ¼ steel mesh although any suitable material and mesh size may be used such as ⅛ mesh made of stainless steel, brass, copper, plastic, intumescent material or other. The interior of chimney 21, from screened floor 23 to input/exhaust channels 22A and 22B and between side openings 26A and 26B may be filled with any suitable filter mesh or wool 27 which is a flame-resistant interwoven mesh which may be any suitable material such as stainless steel. In a preferred configuration, filter mesh 27 is stainless steel wool made from alloy type AISI 434 stainless. Similarly, the interior of chimney 11 may also be filled with a filter mesh similar to filter mesh 27.

Input/exhaust channels 22A and 22B may be supported and enhanced by one or more spacers such as spacers 28 extending from wings 20W as shown in input/exhaust channels 22A and 22B. Baffles as discussed above may be used in addition or in place of spacers 28. Wings 20W may optionally include an external diverter 29A and or one or more internal diverters such as diverter 29B.

Figure 9:
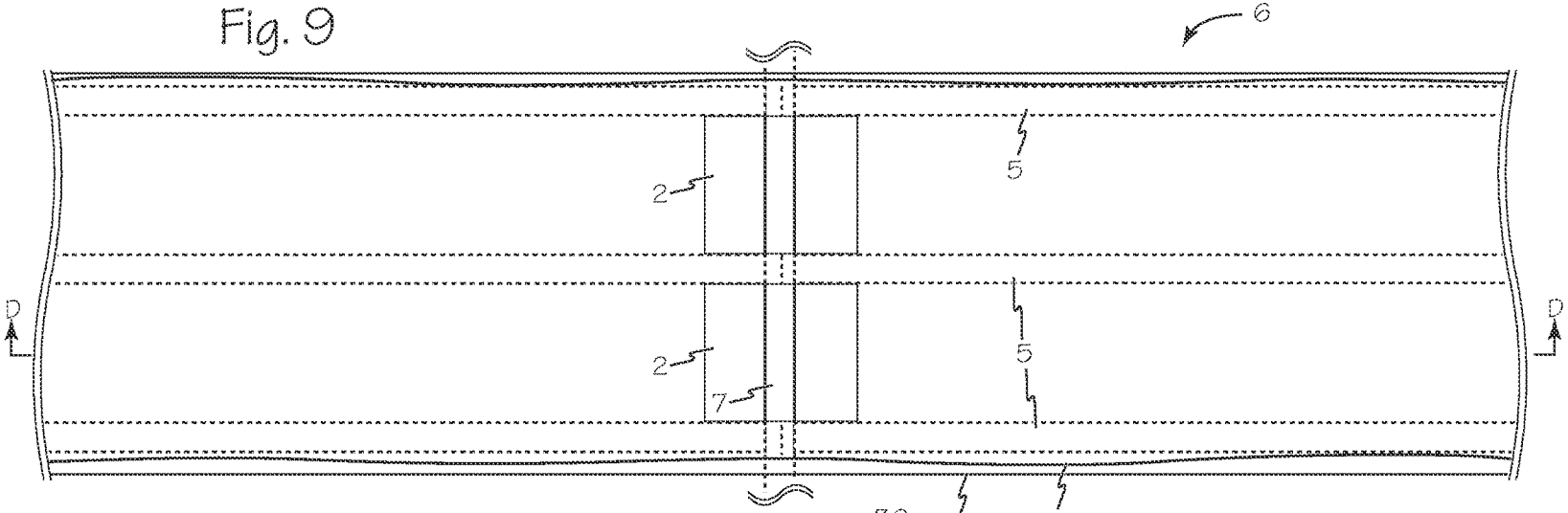
FIG. 9 is a top view of a metal roof with openings adjacent the ridge beam, for ridge straddling passive ridge vents.

For new or existing construction where ridge beams are required, ridge straddling passive ridge vent 30 provides ridge ventilation. FIG. 9 illustrates a top view of metal roof with openings 2 through sheathing 3 and/or the metal roof or metal skin 4, between rafters 5 exposing ridge beam 6. The roof may have battens, bare rafters or any other suitable building technique, instead of sheathing 3, to support the metal roof skin 4.

Figure 11:
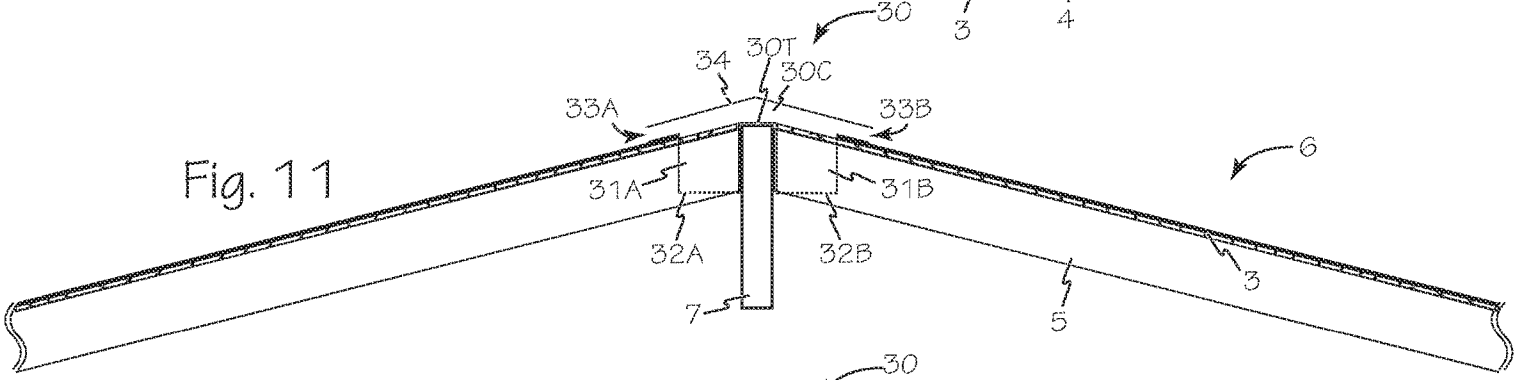
FIG. 11 is a cross-section view of the metal roof of FIG. 9 taken along D-D with a cross-section of the ridge straddling passive ridge vent of FIG. 10 taken along E-E.
Figure 12:
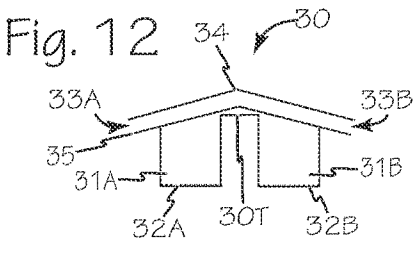
FIG. 12 is an end view of the ridge straddling passive ridge vent of FIG. 10.
Figure 10:
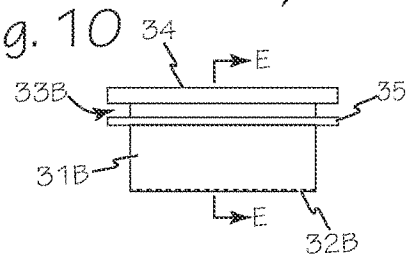
FIG. 10 is a side view of a ridge straddling passive ridge vent.

FIG. 11 illustrates a cross-section view of the metal roof 1 of FIG. 1 taken along D-D, with a cross-section of the ridge straddling passive ridge vent 30 of FIG. 10 taken along E-E, installed in roof opening 2. FIGS. 10, 11 and 12 show ridge straddling passive ridge vent 30 is very similar to passive ridge vent 10 discussed above and is formed around parallel, dual vertical chimneys 31A and 31B oriented on each side of ridge beam 7. Each chimney has a screened floor 32A and 32B respectively and the chimneys share input/exhaust channel 30C which extends from vent opening 33A, above chimney 31A, to vent opening 33B above chimney 31B along top 30T of the chimneys which straddles ridge beam 7. Screened floors 32A and B are made with any suitable screen such as ¼ steel mesh although any suitable material and mesh size may be used such as ⅛ mesh made of stainless steel, brass, copper, plastic, intumescent material or other. The top of ridge straddling passive ridge vent 30 is covered by a solid cap 34 which overhangs the sides and ends of vent 30 as illustrated in FIGS. 10, 11 and 12. Chimney 11 is supported and sealed to the metal roof skin 4 by bottom wing 35. A plurality of baffles and or spacers 36A such as those illustrated above may be incorporated to maintain the separation between cap 34 and bottom wing 35 and in the case of baffles 36B they control airflow through the input/exhaust channels and prevent the entry of wind driven fire, embers, or rain.

Each of parallel chimneys 31A and 31B may also include optional side openings as discussed above with respect to passive ridge vent 20. The interior of chimneys 31A and 31B, from screened floor 32 to input/exhaust channels 33B A and 33B may be filled with any suitable filter mesh or wool such as filter mesh 27 as discussed above.

Passive ridge vents 20 and 30 may also include optional input/exhaust screen 12S as discussed above with reference to passive ridge vent 10.

While the preferred embodiments of the devices and methods have been described in reference to the environment in which they were developed, they are merely illustrative of the principles of the inventions. The elements of the various embodiments may be incorporated into each of the other species to obtain the benefits of those elements in combination with such other species, and the various beneficial features may be employed in embodiments alone or in combination with each other. Other embodiments and configurations may be devised without departing from the spirit of the inventions and the scope of the appended claims.

We claim:

1. A passive ridge vent for a metal roof with rafters comprising:

a generally vertical chimney having two long sides and two short sides, a bottom and a top with a screen floor at the bottom and a wing surrounding the chimney adapted to support the chimney and engage the metal roof at the top;

wherein the wing has an external diverter and at least one internal diverter;

a plurality of spacers engaging the wing and separating the wing from the metal roof defining the input/exhaust channel extending through the long vertical side walls above the wing;

a vertically adjustable cap adapted to engage the chimney and cover the passive ridge vent generally parallel to the wing;

two or more anchors for securing the chimney to at least one of the rafters; and filter mesh filling chimney from the screen floor at the bottom to the input/exhaust channel at the top.

2. The passive ridge vent of claim 1 wherein the plurality of spacers are generally cylindrical.

3. The passive ridge vent of claim 1 wherein the plurality of spacers are generally linear baffles.

4. The passive ridge vent of claim 3 wherein the plurality of generally linear baffles are equally spaced.

5. The passive ridge vent of claim 3 wherein the plurality of generally linear baffles are zig-zag shaped.

6. The passive ridge vent of claim 1 wherein the plurality of spacers are a mixture of generally cylindrical spacers and baffles.

7. The passive ridge vent of claim 3 wherein the plurality of generally linear baffles are unequally spaced.

8. The passive ridge vent of claim 1 further comprising:

a screen enclosing the split input/exhaust channel at the top.

9. The passive ridge vent of claim 1 further comprising:

a side opening on each of the opposing long sides of the chimney between the floor and the input/exhaust channel.

* * * * *